US005560634A

United States Patent [19]

Challande et al.

[11] Patent Number: 5,560,634

[45] Date of Patent: Oct. 1, 1996

[54] BINDING ELEMENT FOR ALPINE SKIS

[75] Inventors: Christian Challande, Cruseilles; Pascal Thomas, Chambery; Pierre Desarmaux, Evires, all of France

[73] Assignee: Salomon S.A., Metz-Tessy, France

[21] Appl. No.: 274,273

[22] Filed: Jul. 13, 1994

[30] Foreign Application Priority Data

Jul. 13, 1993 [FR] France ..... 93 08793

[51] Int. Cl.[6] ..... A63C 9/085

[52] U.S. Cl. ..... 280/634; 280/636; 280/612

[58] Field of Search ..... 280/607, 612, 280/629, 630, 632, 634, 636

[56] References Cited

U.S. PATENT DOCUMENTS

| | | | |
|---|---|---|---|
| 4,538,828 | 9/1985 | Dimier | 280/628 |
| 4,561,673 | 12/1985 | Pascal et al. | 280/629 |
| 4,984,816 | 1/1991 | Rullier | 280/625 |
| 5,040,821 | 8/1991 | Berthet et al. | 280/625 |
| 5,044,658 | 9/1991 | Challande et al. | 280/631 |
| 5,114,174 | 5/1992 | Bogner | 280/636 |
| 5,303,950 | 4/1994 | Rigal et al. | 280/636 |

FOREIGN PATENT DOCUMENTS

| | | | |
|---|---|---|---|
| 0102868 | 12/1986 | European Pat. Off. | A63C 9/085 |
| 0447779 | 9/1991 | European Pat. Off. | A63C 9/00 |
| 2517214 | 6/1983 | France | A63C 9/08 |
| 2627095 | 8/1989 | France | A63C 9/08 |
| 2905837 | 8/1980 | Germany | A63C 9/085 |
| 3335878 | 4/1984 | Germany | A63C 9/085 |
| 4003536 | 8/1990 | Germany | A63C 9/085 |
| WO92/03194 | 3/1990 | WIPO | A63C 9/00 |
| WO91/09654 | 7/1991 | WIPO | A63C 5/075 |

*Primary Examiner*—Richard M. Camby
*Attorney, Agent, or Firm*—Greenblum & Bernstein P.L.C.

[57] ABSTRACT

The invention is related to a binding element for skis, especially a front element. The element includes a base connected to the ski, a body mounted on the base, a jaw, an energy spring housed in the body to elastically oppose the opening movements of the jaw in response to lateral and vertical biases of the boot, a support plate on which the sole of the boot rests. The support plate is mobile in a rocking motion, and a second circuit for tilting the jaw, generating release of the boot and independent of the energy spring of the jaw, is controlled by the rocking motion of the boot support plate.

18 Claims, 5 Drawing Sheets

Fig- 12
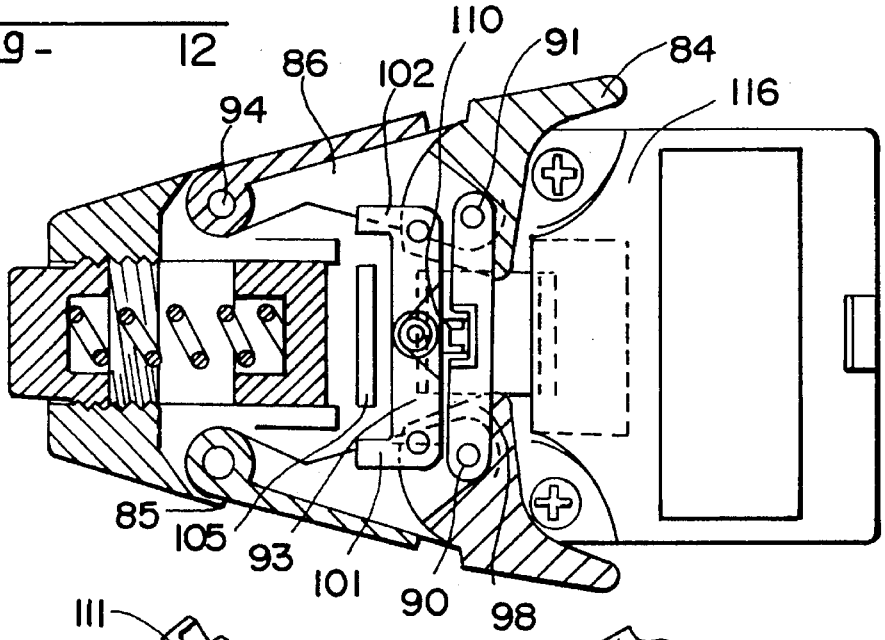
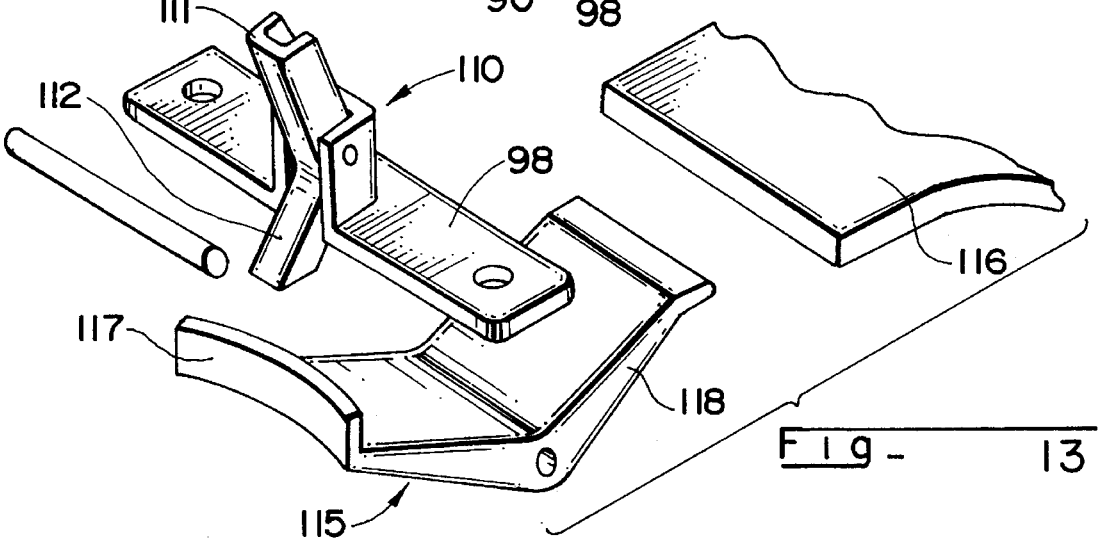
Fig- 13
Fig- 14
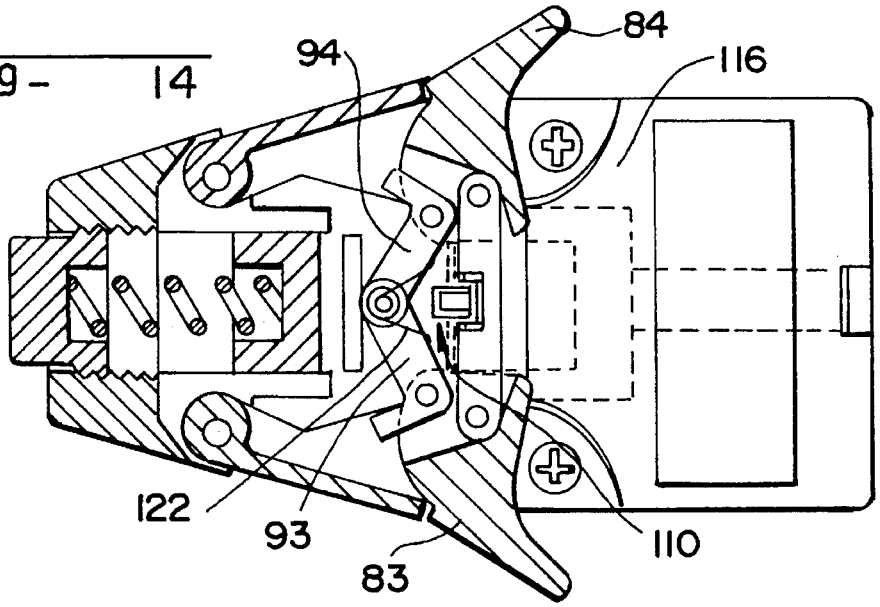

BINDING ELEMENT FOR ALPINE SKIS

BACKGROUND OF THE INVENTION

1. Field of the Invention

The invention is related to a binding element for alpine skis intended to retain a boot in support on a ski and to release the boot in case of excessive biasing.

2. Discussion of Background and Material Information

It is known to retain a boot in support on a ski by means of a front binding element and a rear binding element. Each retention element has a jaw carried by a body which is mobile against the return force exerted by an energy spring, generally a compression spring.

More specifically, the invention is related to a front binding element. Usually, the front binding element reacts to a lateral bias of the front end of the boot. Such a bias stems from a pure torsional bias on the skier's leg.

Certain binding elements also react to an upward vertical bias. Such a bias corresponds to a backward fall of the skier. European Patent Publication No. 102868, for example, describes such a binding.

Other bindings have a compensation mechanism that reacts in the case of a torsional bias combined with a forward fall of the skier. Such a mechanism is described, for example, in German Patent Publication No. 2905837. This mechanism comprises a vertically mobile boot support plate, whose movement, generated by a downward vertical pressure of the boot, reduces the return force that the spring exerts on the jaw.

Another mechanism is described in German Patent Publication No. 3335878. This mechanism also comprises a vertically mobile boot support plate which forces the jaw to be displaced in the direction of the release of the boot.

Such devices compensate for the increased friction from the boot on its supports, induced by the forward component of the fall. These mechanisms are satisfactory as long as the lateral component of the fall remains preponderant with respect to the vertical component.

Now, it happens that in the case of certain so-called "front-torsion" falls, i.e., with a forward component and a lateral component, the lateral component is not sufficient to generate lateral tilting of the jaw. A twisting of the boot which is then witnessed, which boot becomes wedged between the jaw and its support plate. Currently known compensation mechanisms are not sufficiently active to generate opening of the jaw. Sometimes these falls are dangerous and cause injuries, especially in the area of the skier's knees.

SUMMARY OF THE INVENTION

One of the objects of the invention is to propose a binding element that releases the boot, especially in the case of a front-torsion fall where the lateral component is relatively low.

Another object of the invention is to propose a binding element that is relatively simple to construct.

Other objects and advantages of the invention will become apparent upon reading the following description, this description however, being provided as a non-limiting example.

The binding element for alpine skis according to the invention includes a base connected to the ski; a body mounted to the base; a boot retention jaw borne by the body; the jaw comprising two lateral boot retention wings and a vertically retained sole clamp; an energy spring housed in the body to elastically oppose the opening movements of the jaw in response to biases of the boot; and a support plate on which the sole of the boot rests.

A particular feature of the invention is that the support plate is mobile for a rocking motion, and wherein a second tilting circuit of the jaw generates a release of the boot whose opening is controlled by the rocking motion of the boot support plate.

According to another feature of the invention, one of the elements, including the base, body, wings or sole clamp is connected to the element that bears it or on which it is mounted by a journal means and a disengaging means whose opening is controlled by the rocking motion of the boot support plate.

BRIEF DESCRIPTION OF THE DRAWINGS

The invention will be better understood with reference to the description below and the annexed drawings which form an integral portion thereof.

FIGS. *6a, 6b, 6c* illustrate a preferred embodiment of the connection between the support plate and the base.

Figure 7:
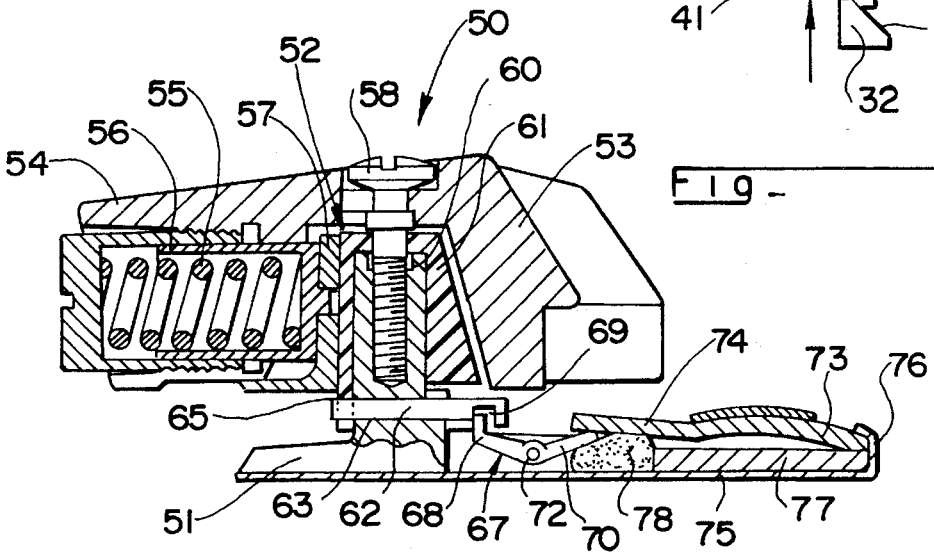

FIG. 7 represents a side and partial sectional view of a binding element and illustrates another embodiment of the invention.

Figure 1:
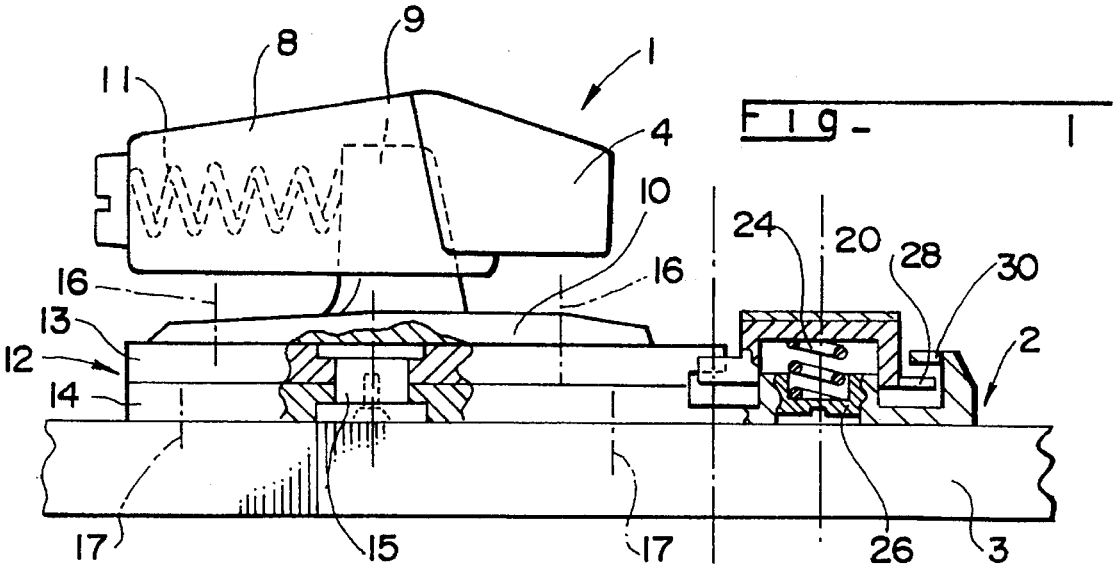
FIG. 1 illustrates a side and partial sectional view of a first embodiment of the invention.
Figure 2:
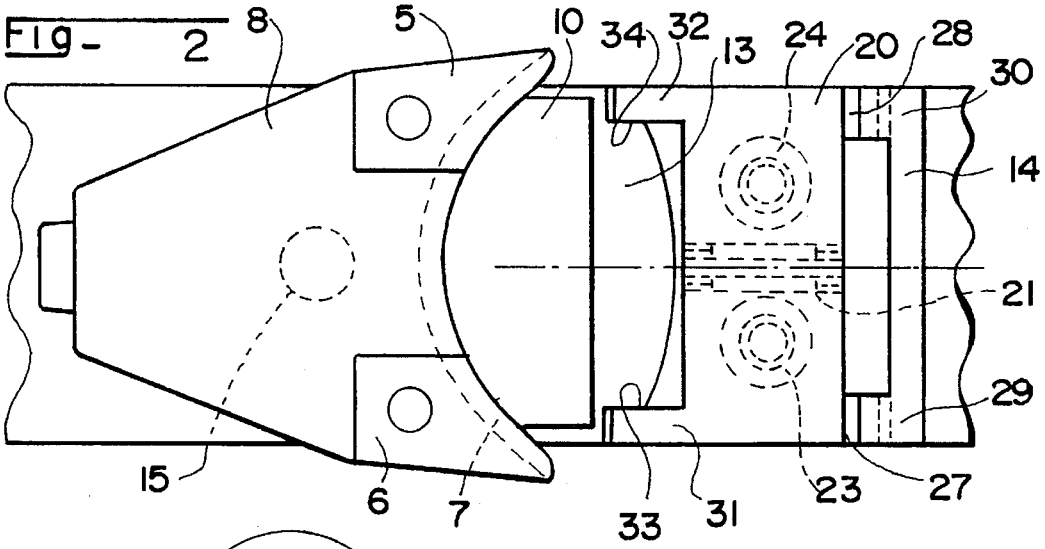
FIG. 2 is a top view of the binding element of FIG. 1.
Figure 8:
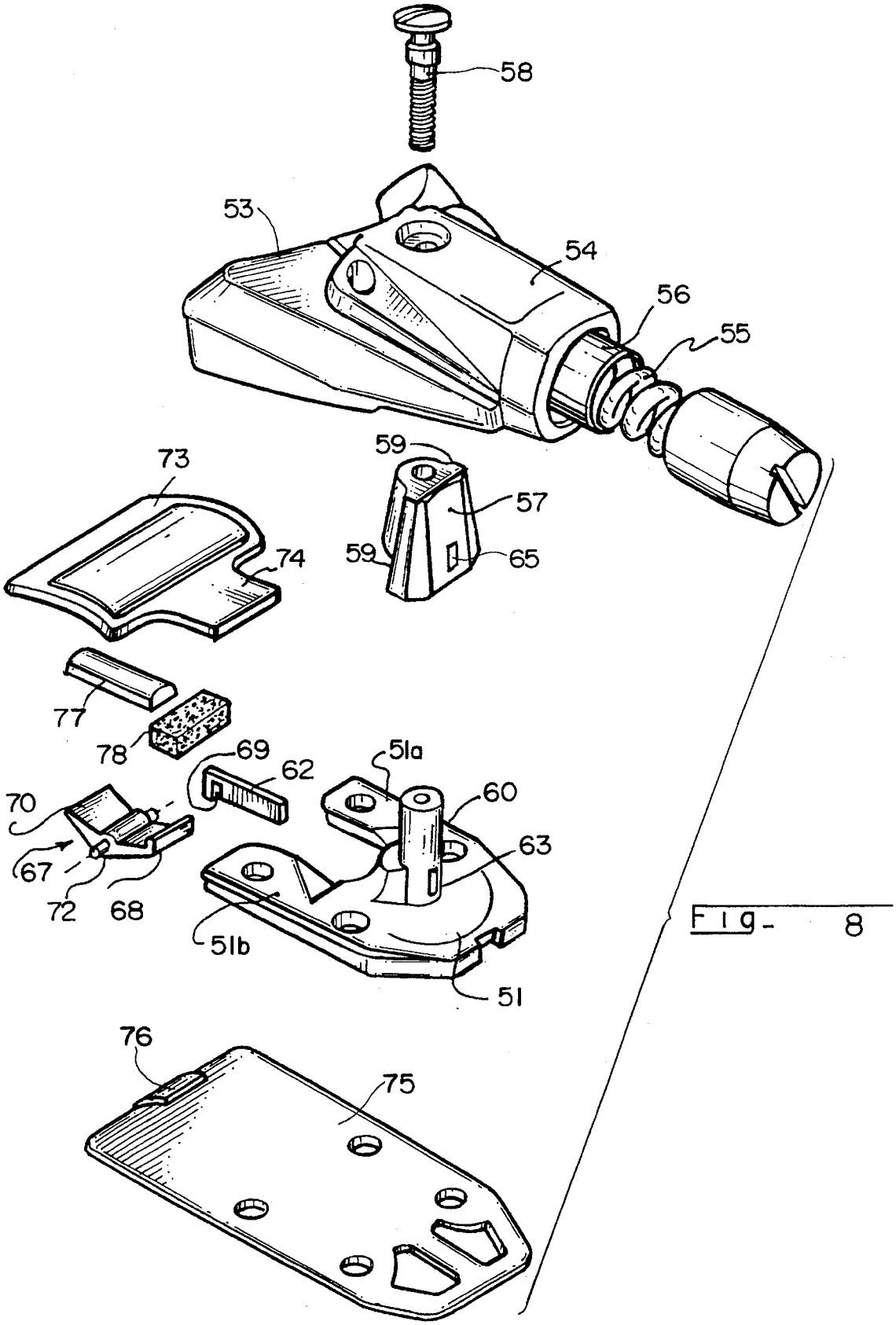

FIG. 8 represents an exploded perspective of the binding element of FIG. 1.

Figure 9:
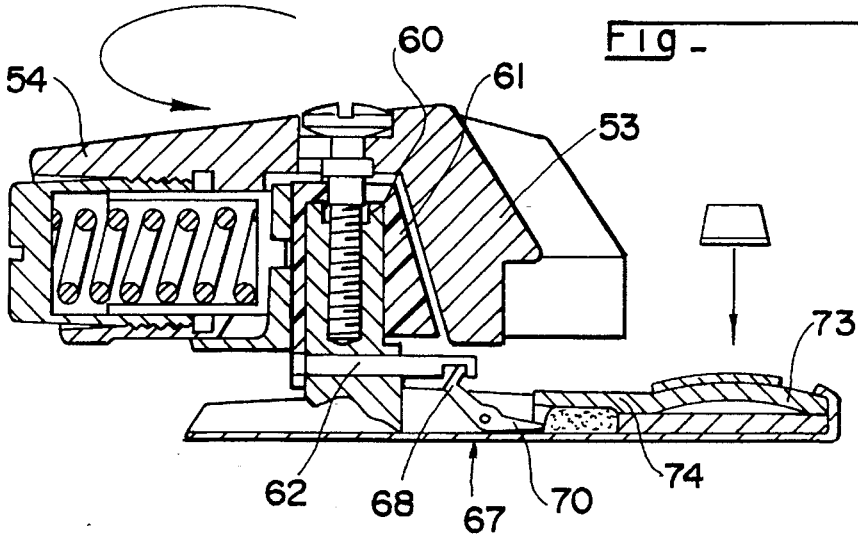

FIG. 9 illustrates the operation of the binding element.

Figure 10:
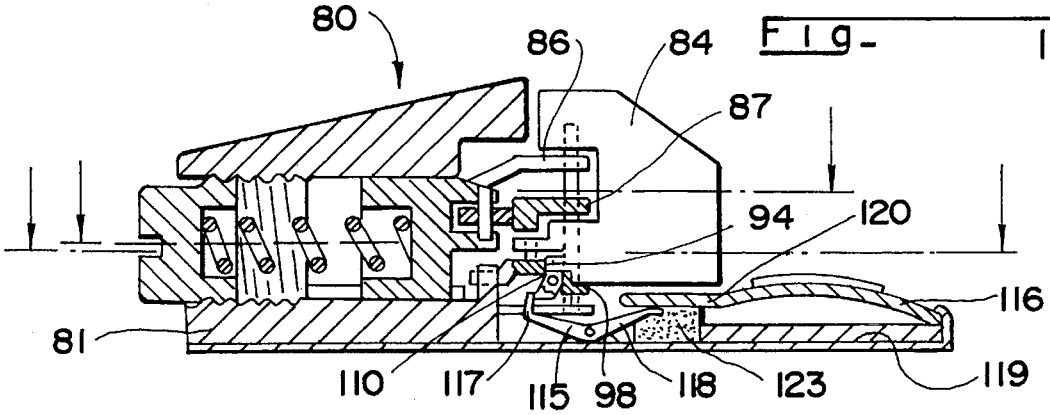

FIG. 10 represents a side view and a partial sectional view of a binding element and illustrates another embodiment of the invention.

Figure 11:
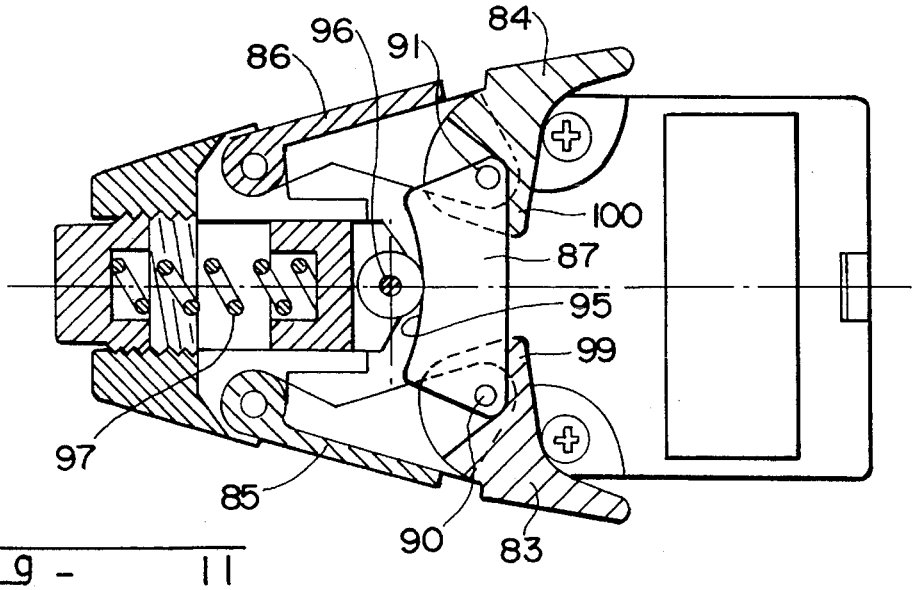

FIG. 11 is a partial sectional top view of the binding element of FIG. 10 in the area of the energy spring.

FIG. 12 is a partial sectional top view of the binding element of FIG. 10 in the area of the latching connecting rods of the wings.

FIG. 13 represents an exploded perspective of the actuation lever of the toggle joint and of the tie-bar which bears it.

FIG. 14 illustrates the operation of the binding element of FIG. 10.

DETAILED DESCRIPTION OF THE PREFERRED EMBODIMENTS

FIG. 1 represents a front binding element 1, which is mounted in the mounting zone 2 of a ski 3. The binding element 1 is of a known type.

The binding element is of any appropriate type, and its construction is non-limiting for the embodiment illustrated in FIGS. 1 to 6. The element represented is of a construction described, for example, in French Patent Publication No. 2517214.

The element represented in FIG. 1 has a front boot retention jaw.

In a known manner, the jaw comprises two lateral boot retention wings 5 and 6. It further comprises a vertically retaining sole clamp 7. Jaw 4 is carried by a body 8.

In the example illustrated, the jaw and the body are monobloc. They are pivotally mounted about a pivot affixed to a base 10, schematically depicted by reference numeral 9. The binding element is connected to the ski by means of base 10. The body and jaw can pivot, at least laterally, about pivot 9 against the elastic return force opposed by a spring 11, housed in body 8.

With reference to FIG. 1, base 10 is connected to the ski by means of a structure 12. Structure 12 is represented in two superposed portions, namely, an upper plate 13, and a lower member 14 that are mutually assembled by a pivot 15 with a vertical axis. The lower member and the upper plate can rotate freely with respect to one another about this pivot.

Base 10 of binding element 1 is fixedly assembled to upper plate 13 by any appropriate means, such as screws schematically depicted by dotted lines 16.

As for lower member 14, it is fixedly assembled to ski 3 in mounting zone 2 provided for the front binding element, by any appropriate means, such as screws schematically depicted by dotted lines 17.

Furthermore, binding element 1 comprises a support plate 20 of a general rectangular shape, seen from the top. The support plate is intended to receive the front of the sole of the boot. In the illustrated example, it has affixed thereon a plate of anti-friction material, polytetrafluoroethylene for example, to facilitate lateral sliding of the sole of the boot.

Figure 3:
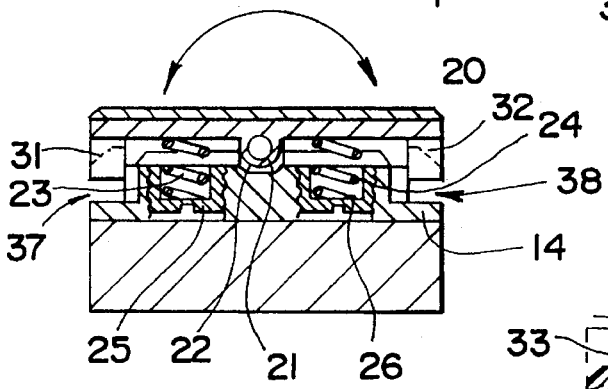
FIG. 3 is a transverse sectional view of the binding element of FIG. 1 in the area of the support plate.

Support plate 20 is mounted to oscillate about a horizontal and longitudinal axis by means of a pin or axle 21. As shown in FIG. 3 for example, support axle 20 is borne by lugs 22 of lower member 14. Axle 21 is located in the median portion of the support plate so that the plate is maintained substantially horizontal when the boot is engaged without stress in the binding element.

Furthermore, support plate 20 is maintained in and elastically returned to this nominal position by two springs 23 and 24 that are positioned on either side of axle 21, so as to exert opposing forces on the plate while taking support on lower portion 14 of the member. Preferably, a means such as a threaded plug 25, 26 screwed in lower portion 14 enables adjustment of the initial compression of the springs.

Preferably, stoppers 27 and 28, affixed to the support plate, cooperate with abutments 29 and 30 of the lower portion of the base to limit the oscillation movement amplitude of the support plate. In the illustrated example, the stoppers are located in the lower portion of the support plate, beneath the base abutments. Naturally, any other arrangement is suitable.

Towards the front, i.e., towards upper plate 13 of the base, support plate 20 has two lateral lugs 31 and 32. These lugs are located level with the rear edge of upper plate 13. The rear edge of upper plate 13 is thus found engaged between lugs 31 and 32 when support plate 20 is in nominal position, so that upper plate 31 is immobilized in the axis of lower member 14. Preferably, between lugs 13, 32, and lateral edges 33 and 34 of the upper plate, there is just enough clearance to allow the oscillating motion of support plate 20.

Below lateral edges 33 and 34, the size of clearances 37 and 38 is sufficient, so that, following a rocking motion of support plate 20, one or the other of lugs 31, 32, are housed therein, thus releasing the upper plate for a rotational movement about pivot 15.

Figure 4:
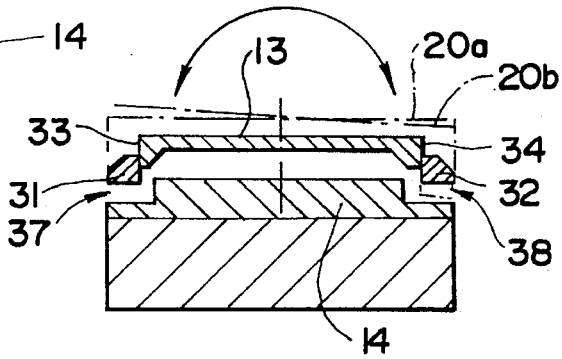
FIG. 4 is a transverse sectional view of the binding element of FIG. 1 in the area of the connection between the support plate and the base.

By reference numeral 20*a* in FIG. 4 the nominal position of plate 20 is schematically shown, in which lugs 31 and 32 maintain upper plate 13 aligned with lower member 14. In 20*b*, plate 20 is represented in a tilted position. In this position, lug 32 is housed in clearance 38, thus leaving its support position against lateral edge 34. The upper plate is released by a horizontal pivoting movement oriented on the side of lug 32, which is lowered. The pivoting amplitude of the plate with respect to the base is sufficient to force the jaw to release the boot.

Figure 5:
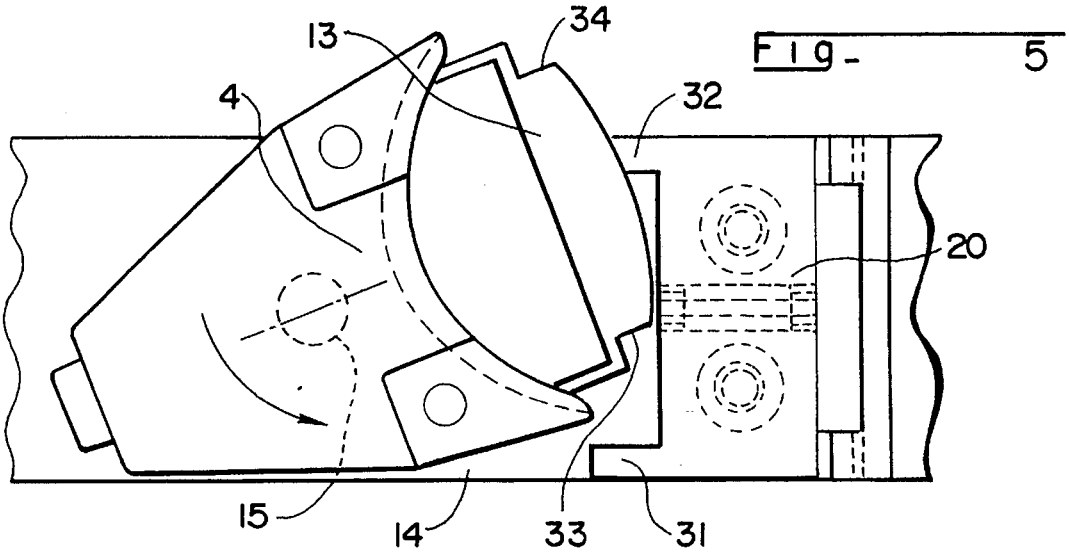
FIG. 5 represents a top view of the element of FIG. 1 following an opening generated by the rocking motion of the support plate.

FIG. 5 illustrates this pivoting movement following the rocking motion of support plate 20. It must be noted that plate 13, and therefore, jaw 4 pivots laterally, independent of return spring 11. This lateral movement is produced without being subject to the control of the return energy. A low lateral component of the boot is sufficient to laterally drive plate 13 through jaw 4. However, this movement can only be initiated after a rocking bias, which forces the support plate to tilt on either side with respect to axle 21.

In other words, by its tilting motion, the support plate controls a second lateral opening circuit of the jaw, which results in the release of the boot. This second circuit is independent of main return spring 11, i.e., it has no direct or indirect action thereon.

In the illustrated embodiment, lugs 31 and 32 are located on the outside of edges 33 and 34 of the upper plate. Preferably, in this case, the lugs and edges each have a ramp oriented from top-to-bottom and from the inside towards the outside, so as to assist the rotation of plate 13 as soon as it is released, in the case where the support plate then returns to the horizontal line.

Figure 6A:
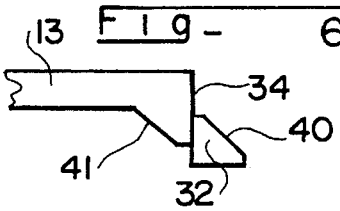
Figure 6B:
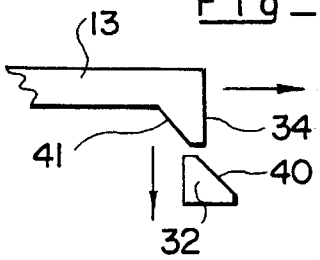
Figure 6C:
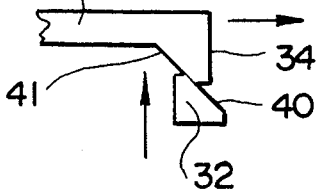

FIGS. 6*a*, 6*b*, 6*c* partially represent upper plate 13 and lug 32 of support plate 20, equipped with such ramps 40, 41.

FIG. 6*a* represents both elements in the position where lug 32 retains plate 13. In FIG. 6*b*, following a rocking motion of plate 20, lug 32 is set back downwards, which laterally releases plate 13. FIG. 6*c* illustrates the case where, after being set back, lug 32 quickly returns to its nominal position, for example, following cessation of the twisting of the boot. In this case, both ramps 40 and 41 come into support against one another and, through their cooperation, exert a motive effect on the lateral pivoting of plate 13. Thus, the release movement of the boot proceeds, even if the support plate returns to its nominal position.

FIG. 7 illustrates an embodiment variation of the invention, according to which binding element 50 has a base 51 affixed to the ski. In the illustrated example, the base is substantially "U"-shaped and open towards the rear, where it has two arms 51*a* and 51*b*.

The base is overlaid by a substantially vertical pivot 52. Jaw 53 and body 54 are monobloc and rotate about pivot 52 against the elastic return force of spring 55 which is housed in the body. In a known manner, the spring is in support, for example, by means of a piston 56 against a support surface 57 of the pivot, which forces the spring to be compressed as soon as the body is distanced from its centered position along the longitudinal axis of the ski. Any appropriate means, a threaded plug, for example, enables adjustment of the initial compression of the body.

According to FIG. 7, a screw 58 enables the body, and thus the jaw, to be adjusted vertically. The body is somewhat suspended at the head of screw 58.

On the other side of surface 57, the pivot has a support surface 59 against which body 55 is borne. For the binding element illustrated in FIG. 7, surface 59 comprises two support lines converging towards a point located above the upper surface of the ski. During its rotation, the body is pressed on one or the other of these two support lines. The convergence point of the support lines is, in fact, constituted by the head of screw 58.

Such a construction is known by one of ordinary skill in the art, according to French Patent Publication No. 2517214, for example. However, it must be noted that such a two-support line construction is non-limiting for the invention.

With reference to FIG. 7, pivot 52 is constructed in two parts an upstanding member having, a central bore 60 and a peripheral ring 61. Central bore 60 is affixed to base 51; it is substantially cylindrical and extends substantially along a vertical direction. Ring 61 is provided to be nested and to pivot freely about bore member 60, at least along a defined angular amplitude, on either side of a nominal position corresponding to the position of the body aligned on the longitudinal axis of the ski. On its front surface, ring 61 bears support surface 57 against which piston 56 rests under the effect of the compression of spring 55. In addition, on its rear surface, spring ring 61 bears support lines 59 on which the body rests in centered position and during its tilting movements. In this manner, since the ring is free to pivot with respect to bore 60, the body and jaw of the binding element may pivot freely with ring 61, and no longer against the return force of spring 55.

However, the ring is connected to the bore of the pivot by a latch 62 that maintains it in its nominal position, i.e., corresponding to the position of the body aligned with the longitudinal axis of the ski.

According to FIG. 7, latch 62 is constituted by a connector bar sliding along a substantially longitudinal and horizontal direction. Connector bar 62 is guided into a housing 63 located at the base of bore member 60, and towards the front, it is engaged in an opening 63 of ring 61. Towards the rear, it opens between arms 51*a* and 51*b* of the base.

As long as the connector bar is engaged in opening 63 of ring 61, the ring is fixedly connected to the bore member 60 of the pivot 52, and the rotation of the body induces a compression of spring 55.

The movement of connector bar 62 from its latching position with ring 61 to its unlatching position, is controlled by a tipping element 67 whose approximately vertical arm 68 is engaged in a notch 69 of connector bar 62, and another arm 70 is oriented obliquely towards the rear. Tipping element 67 is housed between both arms 51*a* and 51*b* of the base. It is, for example, connected to an axis 72 about which it pivots. Axis 72 is maintained by its ends in arms 51*a* and 51*b* of the base. A support pedal 73 is located behind the tipping element. The pedal is intended to support the front end of the boot. It can pivot for a rocking motion, and towards the front it has a tongue 74 which is in support on arm 70 of the tipping element. For any rocking motion on either side of its horizontal position, tongue 74 presses on arm 70 of the tipping element which drives the tipping element in rotation about its axis 72, resulting in a longitudinal movement of connector bar 62 in the direction of an unlatching of ring 61.

In the example shown, support plate 73 is located above a metal plate 75 which extends beneath the support plate and partially beneath base 51. A bar 77 of relatively hard material is located between plate 73 and metal foil 75. This bar is located in the area of the median portion of the support plate, along a longitudinal direction. It forms a sort of longitudinal hinge on which support plate 73 is pressed, and with respect to which it oscillates laterally. As in the preceding case, the oscillating movement of the support plate can be impeded or controlled by any appropriate means, for example, by coil springs located on each of side of bar 77.

Towards the front, in the area of the tongue and arm 70 of tipping element 67, a block of elastically deformable material 78 ensures the elastic return of support plate 73, tipping element 67 and connector bar 62 in a latching position. Naturally, any other elastic return means is suitable, for example, a wire spring.

Support plate 73 is maintained by any appropriate means, and for example, by a central tab 76 of metal plate 75 and/or by adhesion of bar 77 beneath the plate and on the metal plate.

The binding element operates in the following manner. In nominal position, support plate 73 is horizontal. Connector bar 62 latches ring 61 in nominal position. The body of the binding can pivot laterally against the elastic return force of spring 55. Plate 73 cannot descend vertically, or not enough to unlatch connector bar 62.

In the case of a front torsion fall which twists the boot, support plate 73 tilts to the side. One of the sides of tongue 74 presses on arm 70 of the tipping element and drives it in rotation, resulting in a rearward sliding of connector bar 62. If the sliding is sufficient, the connector bar releases ring 61, and body 54 can turn freely from the side where it is driven by the boot, until the release thereof. If it was compressed, spring 55 is released.

FIG. 9 illustrates this operational phase of the binding element.

The body is then returned to its initial position by a simple manipulation. Connector bar 62 automatically returns to its latching position of ring 61.

According to a variation of this embodiment, the axis of rotation of ring 61 is slightly inclined from bottom-to-top and from back-to-front. Because of this, in case of free pivoting about the ring, the jaw is raised while pivoting, which provides the sole with more space and facilitates its release.

FIG. 10 illustrates another embodiment variation of the invention. According to this variation, binding 80 has a fixedly connected base and a body 81 which is immobile with respect to the base, at least in a horizontal plane.

The jaw comprises two wings 83 and 84. In the illustrated example, the sole clamp is in two parts incorporated into each of the wings. The wings are connected to the body by two arms 85 and 86, journalled with respect to the base. In addition, they are mutually connected by a tie-bar 87. Arms 85, 86, tie-bar 87 and the wings are journalled in the area of each end of the tie-bar about axes 90, 91. The arms and the tie-bar form with the base a sort of deformable journalled quadrilateral construction. Towards the front, tie-bar 87 bears a ramp 95 against which a roller 96 is pressed, pushed back by a spring 97.

Furthermore, wings 83 and 84 are maintained closed in maintaining position of the boot, by two connecting rods 93 and 94 journalled in the manner of a toggle joint. The connecting rods are connected to the wings by journal axes located in front of axes 90 and 91.

In a normal position, the toggle joint formed by the two connecting rods is maintained in a normally closed position, and the central point of the toggle joint is maintained in support against a lower tie-bar 98 which connects axes 90 and 91 parallel to tie-bar 87, but at a lower level. In addition, wings 83 and 84 have, towards the inside, a return 99 and 100 which, in normal position, takes support against tie-bar 87. In the normally closed position of the toggle joint formed by the two connecting rods, these returns prevent one wing from opening while taking support on the other.

Each of two connecting rods 93 and 94 has a return 101, 102 extend towards the outside, which is oriented substantially frontwardly at a right angle. Between the two returns, along the median longitudinal axis of the binding element there is a central pin 105 affixed to base 81. During skiing, the jaw is offset laterally by a force exerted by of the boot. As soon as a return 101, 102 comes to rest on central pin 105, the toggle joint formed by connecting rods 93, 94 opens, which unlocks both wings 83 and 84, thus enabling their opening and release of the boot.

Such a binding is described in French Patent Publication No. 2656808, for example. However, this construction is only described as an example, and is non-limiting for the invention.

The opening of the toggle joint can also be controlled by a second circuit. This circuit comprises a two-armed lever 110 which is journalled about a transverse axis borne by lower tie-bar 98. Upper arm 111 of the lever is in support against the central journal of the toggle joint. The other arm 112 extends downwardly, and is driven by an assembly constituted by a tipping element 115 and a support plate 116, mobile in a rocking motion of the same type as the aforementioned tipping element 67 and support plate 73.

The tipping element has an approximately vertical arm 117 whose width is sufficient to actuate lever 110 at least when the jaw is located in the vicinity of its centered position.

The other oblique arm 118 of the tipping element is actuated by tongue 120 of support plate 116. As in the preceding case, support plate 116 is mobile for a rocking motion, for example, by means of a central and longitudinal bar 119 which bears it. Such a construction was already described in the preceding embodiment, and will not be described in detail again.

The operation of this binding element is as follows. In normal operation, the boot biases the jaw, which generates its lateral displacement. If the displacement amplitude is excessive, one of the returns 101, 102 generates the opening of the toggle joint, resulting in an opening of the wings and release of the boot.

However, if the boot biases the support plate in a rocking motion, tipping element 115 actuates lever 110, which generates opening of the toggle joint, opening of the wings and release of the boot, even if the lateral displacement of the jaw is nonexistent or slight.

FIG. 14 shows such an operational phase of this binding element.

The toggle joint returns to the resting position by any appropriate means, and for example, by a small coil spring 122, located in the area of the toggle joint journal, acting on each of the levers, and a block of elastically deformable material 123 located beneath the tongue of the support plate and beneath the oblique arm of the tipping element.

Thus, it is apparent from the various embodiments described, that according to the invention, a second circuit for opening the jaw and releasing the boot is actuated by the rocking motion of the boot support plate. This second circuit generates an unlatching between an element including the base, body, or jaw, and the element which bears it, i.e., a pedestal, the base, the body, respectively.

The second circuit is independent of the elastic return circuit of the jaw, i.e., it has no direct or indirect action on the return spring of the jaw.

The instant application is based upon French patent application 93.08793 of Jul. 13, 1993, the disclosure of which is hereby expressly incorporated by reference thereto, and the priority of which is hereby claimed.

Finally, although the invention has been described with reference of particular means, materials and embodiments, it is to be understood that the invention is not limited to the particulars disclosed and extends to all equivalents within the scope of the claims. Further, the present description is only provided as an example, and one could adopt other embodiments of the invention without departing from the scope thereof.

What is claimed:

1. A binding for retaining a boot on an alpine ski, said binding comprising:

a base for attachment to a ski;

a body mounted on said base;

a retention jaw borne by said body, said retention jaw comprising two laterally opposed retention wings which laterally retain the boot and a sole clamp for which vertically retains the boot;

a first circuit for lateral movement of said retention wings about a pivot axis and a spring housed in said body which elastically opposes opening movements of said jaw in response to forces transmitted by the boot;

a second circuit, independent of said first circuit, for lateral movement of said retention wings about said pivot axis;

a support plate that supports a sole of the boot; and a means for defining a transverse rocking motion of said support plate on either side of a rest position, said support plate having a portion for controlling lateral movement of said retention wings and opening of said second circuit, generating release of the boot from the binding, in response to said rocking motion of said support plate.

2. A binding element according to claim 1, wherein one of the elements including the base, the body, the wings, is connected to the element which one of bears it and on which it is mounted by a journal means and by a disengaging means whose opening is controlled by the rocking motion of the boot support plate.

3. A binding element according to claim 2, wherein the base is connected to the ski by means of a member affixed to the ski, wherein the member bears a substantially vertical pivot about which the base is pivotally mounted, and wherein a latch controlled by the rocking motion of the support plate retains the base in the axis of the member.

4. A binding element according to claim 3, wherein the support pedal is journalled in rotation about a median horizontal and longitudinal axis, and wherein it has two lugs on the side of the base between which the base is engaged, wherein the angle of the rocking motion of the plate and the height of the overlapping between the lugs and the lateral edges of the base are determined so that the lugs release the base after a defined tilting of the amplitude of the support pedal.

5. A binding element according to claim 4, wherein two springs exert an upward vertical thrust on the support plate on each side of its median horizontal and longitudinal journal axis.

6. A binding element according to claim 2, wherein the base bears a pivot, wherein the pivot comprises a ring pivotally mounted about a bore affixed to the base, wherein the spring takes support against the ring, wherein a latch secures the ring on the bore, and wherein a linkage connects the support plate to the latch to disengage the ring with respect to the bore of the pivot during excessive rocking motion of the boot support plate.

7. A binding element according to claim 6, wherein the latch is a connector bar slidably guided into a longitudinal opening of the base, a projecting end of which is engaged in a housing of the ring.

8. A binding element according to claim 7, wherein the connector bar is actuated by a two-armed tipping element, one arm connected to the connector bar and the other receiving one end of the support plate in support.

9. A binding element according to claim 2, wherein the jaw comprises two wings, movably journalled about the axes, and wherein the wings are maintained in boot retaining position by a latch whose opening is controlled by the rocking motion of the support plate.

10. A binding element according to claim 9, wherein the latch comprises two connecting rods journalled in the manner of a toggle joint, and a journalled lever actuating the toggle joint in opening position following a rocking motion of the support plate.

11. A binding for retaining a boot on a ski, said binding comprising:

a base for attachment to a ski;

a body mounted on said base;

a retention jaw supported by said body, said retention jaw comprising means for retaining the boot against lateral release and against vertical release from the binding, said retaining means comprising at least one member which engages the boot and is mounted for lateral movement against a force exerted by the boot;

a spring housed in said body arranged to elastically oppose said lateral movement of said at least one member of said retaining means;

a support plate that supports at least a portion of a sole of the boot;

a means for defining a transverse rocking motion of said support plate;

a mounting arrangement for said retention jaw for enabling a boot releasing lateral movement independent of said spring;

a means for disengageably retaining said retention jaw against said boot releasing lateral movement independent of said spring; and an operative connection between said support plate and said means for disengaging said retention jaw and permitting said boot releasing lateral movement independent of said spring in response to said rocking motion of said support plate.

12. A binding element according to claim 11, wherein said means for defining a transverse rocking motion of said support plate comprises a structure that defines a rocking motion about a predetermined longitudinal axis, said longitudinal axis being parallel to a longitudinal direction of the ski.

13. A binding element according to claim 12, wherein said means for defining a transverse rocking motion of said support plate comprises a longitudinally extending journal axle.

14. A binding element according to claim 11, wherein said mounting arrangement for said retention jaw comprises means for mounting said body for lateral pivotal movement with respect to said base independent of said spring.

15. A binding element according to claim 11, wherein said mounting arrangement for said retention jaw comprises means for mounting said at least one member which engages the boot for lateral pivotal movement independent of said spring.

16. A binding element for alpine skis comprising:

a lower base member adapted to be connected the ski;

an upper base member mounted for pivoting above the lower base member by means of a substantially vertical pivot;

a latch which retains the upper base member against pivoting with respect to the lower base member;

a body mounted on the upper base member;

a boot retention jaw carried by the body;

the jaw comprising two retention wings which laterally retain the boot and a sole clamp which vertically retain the boot;

an energy spring housed in the body to elastically oppose the opening movements of the jaw in response to forces exerted by the boot;

a support plate on which the sole of the boot rests, said support plate being mounted for a rocking movement; and a jaw tilting circuit which generates release of the boot is connected to said support plate, whereby said rocking movement of said support plate controls the release of the boot by releasing said latch.

17. A binding element according to claim 16, wherein said jaw tilting circuit is independent of elastic opposing forces exerted by said energy spring.

18. A binding element according to claim 17, further comprising means for confining said support plate to rock about a predetermined longitudinal axis.

* * * * *